United States Patent [19]

Paraskos et al.

[11] 4,217,202

[45] Aug. 12, 1980

[54] PROCESS FOR SELECTIVE RECOVERY OF RELATIVELY METALS-FREE BITUMEN FROM TAR SAND USING A HALOGENATED ALIPHATIC SOLVENT IN COMBINATION WITH A SECOND SOLVENT

[75] Inventors: John A. Paraskos, Pittsburgh, Pa.; Edward W. Smith, Houston, Tex.

[73] Assignee: Gulf Research & Development Company, Pittsburgh, Pa.

[21] Appl. No.: 958,673

[22] Filed: Nov. 8, 1978

Related U.S. Application Data

[63] Continuation-in-part of Ser. No. 844,430, Oct. 21, 1977, abandoned.

[51] Int. Cl.[2] ..... C10G 1/00

[52] U.S. Cl. ..... 208/11 LE

[58] Field of Search ..... 208/11 LE

[56] References Cited

U.S. PATENT DOCUMENTS

| | | | |
|---|---|---|---|
| 2,173,842 | 9/1939 | Horner | 208/11 LE X |
| 3,695,354 | 10/1972 | Dilgren et al. | 208/11 LE |
| 3,941,679 | 3/1976 | Smith et al. | 208/11 LE |
| 4,046,668 | 9/1977 | Farcasin et al. | 208/11 LE |

*Primary Examiner*—Delbert E. Gantz
*Assistant Examiner*—William G. Wright

[57] ABSTRACT

A process for the selective recovery of tar sand bitumen from tar sands using a two-solvent system comprising a halogenated aliphatic solvent in combination with a second solvent selected from an oxygenated compound. The process provides for an inexpensive method for selectively removing substantially metal-free tar sand bitumen from tar sands. The bitumen so recovered renders the same amenable to catalytic desulfurization and upgrading processes.

31 Claims, No Drawings

PROCESS FOR SELECTIVE RECOVERY OF RELATIVELY METALS-FREE BITUMEN FROM TAR SAND USING A HALOGENATED ALIPHATIC SOLVENT IN COMBINATION WITH A SECOND SOLVENT

This application is a continuation-in-part of application Ser. No. 844,430, filed Oct. 21, 1977, now abandoned.

BACKGROUND OF THE INVENTION

1. Field of Invention

Deposits of tar sand occur at many localities throughout the world, however, the Athabasca Tar Sand deposit of northern Alberta in Canada represents an estimated reserve which exceeds the combined proven oil reserves of the rest of the world.

The tar sand originated from a deposit of ordinary oil that once lay buried beneath an ancient body of water, for example, a sea. The land area at the bottom of the sea rose and the water disappeared. The oil migrated upward into the still-wet sea floor because the surface pressure was insufficient to hold the oil down. Because the sea floor was still wet when the oil migrated upward, a film of water and seashore clays, including metals, separated each grain of sand from the oil. The oil covered the sand particles, trapping the thin film of water between the oil and sand particles. The oil in the tar sand is no longer oil as we know it because the lighter hydrocarbons evaporated long ago due to the action of sunlight on the original oil. All that is left of the original oil are the heavy, carbon-rich hydrocarbons, plus sulfur and other impurities, for example, various metals, sand and water. The tar-like oil thus defined is in actuality a form of bitumen. Since the original upward migration of the oil through the sea bed, the eons have dumped boulders, gravel, sand, clay and the like atop the tar sand. However, to mine and process the tar sand using conventional methods costs at least three times more than it costs to drill and pump up natural crude. Thus, because of the world's dwindling supply of petroleum and energy-related resources, it is highly desirable to extract oil from tar sand efficiently and economically. In accordance with the process defined and claimed herein, substantially metal-free tar sand bitumen is recovered from tar sand using a halogenated aliphatic solvent in combination with an unsaturated halogenated compound or an oxygenated compound.

With the developing energy shortage, the search for a workable and economically feasible process for extracting oil in the form of bitumen from tar and oil sand has intensified in recent years. Deposits of oil and tar sand occur at many localities throughout the world and represent a potentially large source of oil, however, as to today a workable and economically feasible process for extracting bitumen from these tar sands has not been disclosed.

Many processes for tar-oil sand development have been proposed over the past few years. The processes include direct combustion, solvent extraction, water flotation and many variations of these processes to extract the oil in the form of bitumen. However, the extraction of bitumen from tar sands utilizing past processes has several disadvantages, especially from an economic point of view. One disadvantage of the processes used in the past is a low recovery rate for the bitumen. For example, in a water flotation process only about 50 to about 70 percent of the bitumen is recovered from the tar sand.

Another disadvantage in the case of a solvent extraction process of bitumen from tar sand is that most solvents used in the past have a very strong affinity for the sand, and a significant percentage of the solvent is lost in the extraction and separation step of the process.

Both of the processes above additionally extract undesirable components from the sand particles, for example, metals which contaminate various catalyst systems in a process to upgrade the bitumen to an oil product.

The tar sand herein is characterized by individual grains of sand surrounded by thin films of water which contain sand fines, minerals and metallic contaminants. The thin films of water are further encased by bitumen, with the bitumen partially filling the voids between the individual grains of sand, forming a connecting link in the form of a bitumen bridge. The bitumen contains most of the organometallic compounds which create problems when the bitumen is further processed over typical hydrotreating catalysts which are readily deactivated or posioned by nickel and vanadium. Past attempts to extract bitumen from tar sands resulted in an alteration of the above-described physical configuration and in some oil-wetting of solids; which additionally resulted in oil-rich sludges and solids stabilized emulsions. These sludges and emulsions result in contamination of the bitumen or oil phase with solids and water. Thus, it is very desirable to extract the bitumen from tar sand without rupturing the connate-water envelope containing contaminants, including metals, which surround the individual sand particles.

2. Description of the Prior Art

Several methods have been proposed in the past to extract tar sand bitumen so that it could be processed into oil. For example, Dr. Karl A. Clark, a government scientist, worked out a process in the late 1940's known as the Clark process. The method includes stripping the overburden from the tar sand, mining the tar sand, and extracting the bitumen from the sand using steam and caustic soda. The bitumen is skimmed from the surface of the mixture. The method collects virtually all of the bitumen, however, the bitumen contains about 35 percent water and minerals, including metals.

Another process for recovering bitumen from tar sand is set forth in U.S. Pat. No. 4,017,377, entitled, "Process and Fluid Media for Treatment of Tar Sands to Recover Oil", issued to Fairbanks, Jr., et al, on Apr. 12, 1977. The reference discloses a process, structure, and aqueous bath for recovering oil from tar sand. In particular, the process teaches the steps of contacting the tar sand with a diluent, for example, gasoline and/or naphtha, to reduce the internal fluid friction or viscosity of the oil layers surrounding each sand particle, and then contacting the mixture with an aqueous bath having a slightly raised specific gravity and a wetting agent. The oil is then recovered using conventional methods.

Another method and apparatus for separating hydrocarbonaceous substances from mineral solids is set forth in U.S. Pat. No. 3,941,679, entitled, "Separation of Hydrocarbonaceous Substances from Mineral Solids", issued to Smith et al, on Mar. 2, 1976. In particular, a solvent extraction technique is employed wherein trichlorofluoromethane is used as the primary extraction solvent. The reference is directed to a process for extracting bitumen from both tar sand and shale.

U.S. Pat. No. 4,046,668, entitled "Double Solvent Extraction of Organic Constituents From Tar Sands", issued to Farcasin et al, on Sept. 6, 1977, discloses a process for recovering hydrocarbons from tar sands using a two-solvent system consisting of a naphtha/methanol mixture which separates the organic matter into three phases. It is to be noted that none of the above references teach a process for recovery of relatively metal-free bitumen from tar sand using a two-solvent system comprising a halogenated aliphatic solvent in combination with a second solvent selected from an unsaturated halogenated compound or an oxygenated compound.

SUMMARY OF THE INVENTION

The present invention relates to a process for extracting substantially metal-free bitumen from tar sand which comprises contacting said tar sand with a two-solvent system comprising a halogenated aliphatic solvent of the formula:

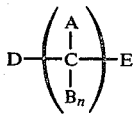

wherein n is an integer of from about 1 to about 20, preferably from about 1 to about 10; and wherein A, B, D and E are either alike or different members selected from the group consisting of hydrogen, chlorine, bromine or fluorine and mixtures thereof, with the provision that at least one of said A, B, D or E is chlorine, bromine or fluorine; in combination with a second solvent comprising an oxygenated compound; agitating said tar sand with said solvent system, sufficient to substantially dissolve said bitumen in said solvent system thereby forming a slurry composed of bitumen dissolved in said solvent system and of said tar sand particles, separating said sand particles from said slurry and then separating said solvents from said bitumen to thereby obtain substantially metal-free bitumen.

DESCRIPTION OF THE PROCESS

The present invention relates to a process for extracting bitumen from tar sand by contacting said tar sand with a two-solvent system comprising a halogenated aliphatic solvent in combination with a second solvent comprising an oxygenated compound, separating the two solvents and bitumen from the tar sand and separating the solvents from the bitumen.

The halogenated aliphatic solvents suitable for use herein preferably are of the formula:

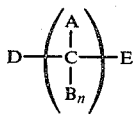

wherein n is an integer of from about 1 to about 20, preferably from about 1 to about 10; and wherein A, B, D and E are either alike or different members selected from the group consisting of hydrogen, chlorine, bromine or fluorine and mixtures thereof, with the provision that at least one of said A, B, D or E is chlorine, bromine or fluorine. Halogenated aliphatic solvents suitable for use therein include:

Methylfluoride;
Fluoroform;
Chloro-fluoromethane;
Bromo-fluoromethane;
Chloro-difluoromethane;
Chloro-trifluoromethane;
Dichloromethane;
Ethylfluoride;
Difluoroethane;
Bromo-fluoroethane;
2-bromo-1, difluoroethane;
Chloro-trifluoroethane;
Difluoro-dichloroethane;
Trifluoro-dichloroethane;
Tetrafluoro-dichloroethane;
1,1, dichloro 2,2 difluoroethane;
1,2, dichloro 1,2 difluoroethane;
1,1,1, trifluoroethane;
1,2, Difluoropropane;
1,3 Difluoropropane;
1,2,3, trifluoropropane;
1, bromo-2, fluoropropane;
1, bromo-3, fluoropropane;
Dichloro-monofluoromethane;
Trichloro-monofluoromethane;
Monochloro-monobromo-monofluoromethane;
Dibromo-monofluoromethane;
Tribromo-monofluoromethane;
Tetrachloro-difluoromethane;
Tribromo-monofluoroethane;
Trichloro-monofluoroethane;
Tetrachloro-monofluoroethane;
Trichloro-difluoroethane;
Dibromo-monofluoroethane;
Trichloro-trifluoroethane;
N-propylfluoride;
Isopropylfuoride;
N-butylfluoride;
N-amylfluoride;
N-hexylfluoride;
or N-heptylfluoride and mixtuures thereof.

Especially desirable halogenated aliphatic solvents suitable for use herein are Freon TF, known under the U.P.A.C. nomenclature system as trichloro-trifluoroethane and Freon 113, known under the U.P.A.C. nomenclature system as 1,2, dichloro 1,2 difluoroethane. These compound are members of the family of fluorocarbon chemicals developed and commercially marketed by the Dupont Company under the well known trademark of Freon. Originally, Freon compounds were developed as refrigerants, however, they presently are widely used as aerosol propellants, solvents, cleaning agents, fire extinguishing agents, dielectric fluids, coolants and relatively stable liquids. Freon compounds are additionally nonflammable, chemically and thermally inert, chemically and physically pure and substantially nontoxic. Previously, Freon compounds have been used to remove oil, grease and dirt from objects without harm to metal, plastic or elastomeric parts. Table I below sets forth in greater detail some rather important properties of Freon TF. It is to be noted that the other fluorocarbon compounds herein exhibit similar properties.

Table I

| | |
|---|---|
| Molecular Wt. | 187.4 |
| Boiling Point at one atmosphere | 117.6° F. (47.6° C.) |
| Freezing Point | −31.0° F. (−35.0° C.) |
| Critical Temperature | 417.4° F. (214.1° C.) |
| Critical Pressure | 495.0 PSIA (33.7 atm) |
| Density at 77° F. (25° C.) | 1.565 gms/CM$^3$ |

Table I-continued

| | |
|---|---|
| Latent Heat of Vaporization at boiling point | 63.12 BTU/lb |
| Viscosity at 70° F. (21.1° C.) | 0.694 centipoises |
| Surface Tension at 77° F. (25° C.) | 19.0 dynes/cm |

The second solvent herein is selected from oxygenated compounds of the formula:

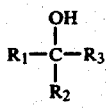

wherein $R_1$, $R_2$ and $R_3$ are either alike or different members selected from the group consisting of hydrogen; straight or branched chain alkyl groups having from about 1 to about 20 carbon atoms, preferably from about 1 to about 10 carbon atoms; especially from about 1 to about 5 carbon atoms.

Suitable oxygenated compounds of the above-described configuration preferably are selected from the group consisting essentially of:

Methanol;
Ethanol;
n-Propanol;
Isopropanol;
n-Butanol;
2-Butanol;
n-Pentanol;
2-Pentanol or
3-Pentanol and mixtures thereof.

An alternate second solvent suitable for use herein comprises oxygenated compounds of the formula:

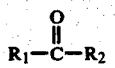

wherein $R_1$ and $R_2$ are either alike or different members selected from straight or branched chain alkyl radicals having from about 1 to about 20 carbon atoms, preferably from about 1 to about 10 carbon atoms, especially from about 1 to about 5 carbon atoms; phenyl, or aryl groups and mixtures thereof.

Suitable oxygenated compounds of the above-described configuration are selected from the group consisting of:

Acetone;
Methyl ethyl ketone;
Diethyl ketone;
Methyl isobutyl ketone;
Ethyl n-butyl ketone;
Di-isobutyl ketone;
Methyl n-heptyl ketone;
Di-n-heptyl ketone;
Methyl phenyl ketone, or
Diphenyl ketone, and mixtures thereof.

Normally, the halogenated aliphatic solvent and second solvent (i.e., oxygenated compound) are in a volume ratio of from about 1:100 to about 100:1, especially from about 1:50 to about 50:1, preferably from about 1:10 to about 10:1.

In a commercial process, before bitumen can be extracted from tar sand, an overburden of up to 150 feet of clay, sand, gravel and boulders have to be stripped from atop the tar sand and after the tar sand is exposed, it is mined and transported to extraction apparatus. It has been determined that approximately two tons of tar sand will produce one barrel of oil. Thus, mining and extraction apparatus tend to be extremely large. Tar sands will normally contain from about 100 PPM to about 500 PPM of metals, generally about 200 PPM to about 400 PPM of metals. In this process, the bitumen so recovered will contain about 100 PPM of metals.

In the claimed process, the mined tar sand as defined above is mixed with the two-solvent system, as herein defined, in an extraction vessel, for example, a revolving rotary drum to form a slurry. The two solvents are generally mixed with the tar sand at a volume ratio of from about 0.5:1 to about 5:1, preferably from about 1:1 to about 3:1 for about 0.5 minute to about 60 minutes, preferably from about 1 minute to about 30 minutes. Preferably, the mixing and extraction steps take place at ambient temperatures and under atmospheric pressure. As a result of such action, the halogenated solvent extracts the bitumen from the tar sand by dissolving the bitumen; at the same time, since the mixing herein is gentle, the water envelope surrounding the sand and containing most of the metals and other contaminants is not required. The total resulting slurry is next pumped into separation cells which can be several stories high and as much as 70 feet across in a typical process.

The extracted bitumen, dissolved in the two solvents, is then separated from the sand (carrying its water envelope substantially intact) in any conventional manner, for example, by draining, filtration, etc. Recovery of the solvents from the solution of solvent and bitumen can easily be effected by subjecting the solution to distillation, since the boiling points of the solvents are much lower than that of the bitumen. Such distillation can be effected, for example, at a temperature of about 48° C. to about 92° C., preferably about 60° C., to about 80° C., and a pressure of about 1.47 to about 300 pounds per square inch gauge (about 1.04 to about 21.09 kilograms per square centimeter), preferably about 14.7 to about 100 pounds per square inch gauge (about 1.04 to about 7.03 kilograms per square centimeter). Accordingly, the bitumen so recovered is not contaminated with the solids and other contaminants present in the water envelope surrounding the tar sand charge and recovery procedures are not complicated by the presence of free water that would have been present had the water envelope been punctured.

DESCRIPTION OF THE PREFERRED EMBODIMENTS

EXAMPLES I&II

In each Example, 2000 grams of Athabasca tar sand containing bitumen, nickel, vanadium, water and other contaminants, were contacted with the described solvent system (see Table I) under gentle agitation for about 10 minutes to about 1 hour, at ambient temperature and ambient pressure. The resulting mixture was permitted to come to rest. Solid tar sand particles, including spent tar sand, water and other contaminants settled to the bottom of the mixture, with the remainder being essentially tar sand bitumen dissolved in the described two-solvent system. No noticeable water was present in the upper solvent phase. The bottom phase was separated from the upper phase by filtration. Conventional methods can be used to separate and recover the bitumen from the solvents, for example, by distillation at about 150° F. (65.5° C.) and ambient pressure. The results are disclosed in Table II as follows.

Table II

| Tar Sands Extraction | | | |
|---|---|---|---|
| EXAMPLE | | I | II |
| Solvent: 1st component | | 65% 1,2 dichloro, 1,2 difluoroethane | 88.9% 1,2 dichloro, 1,2 difluoroethane |
| 2nd component | | 35% isopropyl alcohol | 11.1% acetone |
| Tar Sands Feed: grams | | 2000 | 2000 |
| Solvent/Tar Sands Ratio, wt/wt | | 1.5:1 | 1.5:1 |
| Mixing Time: hr | | 1.0 | 1.0 |
| Mixing Temperature | | Ambient | Ambient |
| Oil Recovered From the Solvent, gms | | 130.0 | 150.7 |
| Yield (wt % of tar sands) | | 6.5 | 7.5 |
| PRODUCT INSPECTIONS | | | |
| Oil Product | | | |
| Sulfur, wt % | | 3.73 | 3.97 |
| Metals, PPM | | | |
| Nickel | | 14 | 23 |
| Vanadium | | 42 | 86 |
| Spent Sand | TAR SANDS FEED | | |
| Carbon, wt % | 10.13 | 2.55 | 2.15 |
| Hydrogen, wt % | 1.27 | 0.33 | 0.20 |

In the above Examples, the tar sand, originally black, was found to be light-medium brown in color. The recovered bitumen contained about 100 PPM or less metals contaminants. Additionally, it is to be noted that the other halogenated aliphatic solvents, unsaturated halogenated compounds and oxygenated compounds can be substituted into the two-solvent system herein with substantially the same results.

EXAMPLE III

A 2000 gram sample of Athabasca tar sand particles containing bitumen, metals (i.e., nickel and vanadium) and other contaminants including water surrounding the individual tar sand particles, was contacted under gentle agitation for 1 hour with 2000 grams of a two-solvent system comprised of 50% 1,2 dichloro, 1,2 difluoroethane and 50% methanol at ambient temperature and ambient pressure. The resulting mixture was allowed to come to rest. Solid tar sand particles including water and other contaminants formed a bottom phase and bitumen dissolved in the above-described solvent system formed a top phase. The two phases were separated by filtration. The bitumen was conveniently separated and recovered from the solvents by distillation at about 150° F. (65.5° C.) and at ambient pressure. There was recovered 64.2 grams of bitumen which contained about 100 PPM or less metals (i.e., nickel and vanadium).

EXAMPLE IV

The procedure of Example IV is followed with the following exceptions: trichloro-trifluoroethane is substituted for the 1,2 dichloro 1,2 difluoroethane and n-propanol is substituted for the methanol. Substantially the same results are obtained with essentially all of the bitumen being recovered from the tar sand.

Obviously, many modifications and variations of the invention, as hereinabove set forth, can be made without departing from the spirit and scope thereof, and therefore only such limitations should be imposed as are indicated in the appended claims.

We claim:

1. A process for extracting substantially metal-free bitumen from tar sand composed of individual grains of sand surrounded by a thin film of water and further encased by an outer layer of bitumen which comprises contacting said tar sand with a two-solvent system comprising a first halogenated aliphatic solvent of the formula:

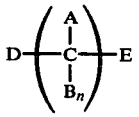

wherein n is an integer of from about 1 to about 20, preferably from about 1 to about 10; and wherein A, B, D and E are either alike or different members selected from the group consisting of hydrogen, chlorine, bromine or fluorine and mixtures thereof, with the provision that at least one of said A, B, D or E is chlorine, bromine or fluorine; in combination with a second solvent comprising an oxygenated compound; agitating said tar sand with said solvent system at ambient temperatures and under atmospheric pressure, sufficient to substantially dissolve said bitumen in said solvent system but without rupturing said film of water, thereby forming two phases, one consisting essentially of said solvents with said bitumen dissolved therein and the other composed of said individual grains of sand carrying solely said film of water, separating said phases from each other and then separating said solvents from said bitumen.

2. The process of claim 1 wherein n is an integer of from about 1 to about 10.

3. The process of claim 1 wherein the halogenated aliphatic solvent is a member selected from the group consisting of:

Methylfluoride;
Fluoroform;
Chloro-fluoromethane;
Bromo-fluoromethane;
Chloro-difluoromethane;
Chloro-trifluoromethane;
Dichloromethane;
Ethylfluoride;
Difluoroethane;
Bromo-fluoroethane;
2-bromo-1,difluoroethane;
Chloro-trifluoroethane;
Difluoro-dichloroethane;

Trifluoro-dichloroethane;
Tetrafluoro-dichloroethane;
1,1, dichloro 2,2 difluoroethane;
1,2, dichloro 1,2 difluoroethane;
1,1,1, trifluoroethane;
1,2, Difluoropropane;
1,3 Difluoropropane;
1,2,3, trifluoropropane;
1, bromo-2, fluoropropane;
1, bromo-3, fluoropropane;
Dichloro-monofluoromethane;
Trichloro-monofluoromethane;
Monochloro-monobromo-monofluoromethane;
Dibromo-monofluoromethane;
Tribromo-monofluoromethane;
Tetrachloro-difluoromethane;
Tribromo-monofluoroethane;
Trichloro-monofluoroethane;
Tetrachloro-monofluoroethane;
Trichloro-difluoroethane;
Dibromo-monofluoroethane;
Trichloro-trifluoroethane;
N-propylfluoride;
Isopropylfluoride;
N-butylfluoride;
N-amylfluoride;
N-hexylfluoride;
or N-heptylfluoride and mixtures thereof.

4. The process of claim 1 wherein the halogenated aliphatic solvent is 1,2 dichloro 1,2 difluoroethane.

5. The process of claim 1 wherein the halogenated aliphatic solvent is trichloro-trifluoroethane.

6. The process of claim 1 wherein the second solvent is an oxygenated compound of the formula:

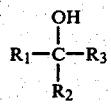

wherein $R_1$, $R_2$ and $R_3$ are either alike or different members selected from the group consisting of hydrogen; straight or branched chain alkyl groups having from about 1 to about 20 carbon atoms.

7. The process of claim 1 wherein the second solvent is an oxygenated compound of the formula:

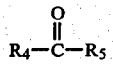

wherein $R_4$ and $R_5$ are either alike or different members selected from straight or branched chain alkyl radicals having from about 1 to about 20 carbon atoms; phenyl; or aryl groups and mixtures thereof.

8. The process of claim 1 wherein the halogenated aliphatic solvent and oxygenated compound are in a volume ratio of from about 1:100 to about 100:1.

9. The process of claim 1 wherein the halogenated aliphatic solvent and oxygenated compound are in a volume ratio of from about 1:50 to about 50:1.

10. The process of claim 1 wherein the halogenated aliphatic solvent and oxygenated compound are in a volume ratio of from about 1:10 to about 10:1.

11. The process of claim 1 wherein the tar sand comprises sand particles surrounded by a thin film of water and contaminants, which are further encased by bitumen.

12. The process of claim 1 wherein the tar sand comprises sand particles surrounded by a thin film of water and metals, which are further encased by bitumen.

13. The process of claim 1 wherein the tar sand comprises bitumen which is impregnated with metals, fines and other contaminants.

14. The process of claim 1 wherein the first and second solvents are mixed with tar sand in a volume ratio of from about 0.5:1 to about 5:1.

15. The process of claim 1 wherein the first and second solvents are mixed with tar sand in a volume ratio of from about 1:1 to about 3:1.

16. The process of claim 1 wherein the first and second solvents are mixed with tar sand for about 0.5 minute to about 60 minutes.

17. The process of claim 1 wherein the first and second solvents are mixed with tar sand for about 1 minute to about 30 minutes.

18. The process of claim 1 wherein the first and second solvents and bitumen are separated from the sand by filtering.

19. The process of claim 1 wherein the first and second solvents are stripped from the bitumen by distillation.

20. The process according to claim 1 wherein the tar sand comprises from about 100 PPM to about 500 PPM of nickel or vanadium and mixtures thereof.

21. The process according to claim 1 wherein the tar sand comprises from about 200 PPM to about 400 PPM of nickel or vanadium and mixtures thereof.

22. The process according to claim 1 wherein the separated bitumen contains less than about 100 PPM of metals.

23. The process of claim 6 wherein $R_1$, $R_2$ and $R_3$ are either alike or different members selected from the group consisting of hydrogen; straight or branched chain alkyl groups having from about 1 to about 10 carbon atoms.

24. The process of claim 6 wherein $R_1$, $R_2$ and $R_3$ are either alike or different members selected from the group consisting of hydrogen; straight or branched chain alkyl groups having from about 1 to about 3 carbon atoms.

25. The process of claim 6 wherein the second solvent is a member selected from the group consisting of:
Methanol;
Ethanol;
n-Propanol;
Isopropanol;
n-Butanol;
2-Butanol;
n-Pentanol;
2-Pentanol, or
3-Pentanol and mixtures thereof.

26. The process of claim 6 wherein the second solvent is methanol.

27. The process of claim 6 wherein the second solvent is isopropanol.

28. The process of claim 7 wherein $R_4$ and $R_5$ are either alike or different members selected from straight or branched chain alkyl radicals having from about 1 to about 10 carbon atoms.

29. The process of claim 7 wherein $R_4$ and $R_5$ are either alike or different members selected from straight or branched chain alkyl radicals having from about 1 to about 5 carbon atoms.

30. The process of claim 7 wherein the second solvent is a member selected from the group consisting of:

Acetone;
Methyl ethyl ketone;
Diethyl ketone;
Methyl isobutyl ketone;
Ethyl n-butyl ketone;
Di-isobutyl ketone;
Methyl n-heptyl ketone;
Di-n-heptyl ketone;
Methyl phenyl ketone, or
Diphenyl ketone, and mixtures thereof.

31. The process of claim 7 wherein the second solvent is acetone.

* * * * *

UNITED STATES PATENT OFFICE

CERTIFICATE OF CORRECTION

Patent No. 4,217,202 Dated August 12, 1980

Inventor(s) John A. Paraskos and Edward W. Smith

It is certified that error appears in the above-identified patent and that said Letters Patent are hereby corrected as shown below:

COLUMN 6, line 24, "required" should read

--ruptured--.

Signed and Sealed this

*Eleventh* Day of *November 1980*

[SEAL]

*Attest:*

SIDNEY A. DIAMOND

*Attesting Officer*

*Commissioner of Patents and Trademarks*